US012680747B2

(12) United States Patent
Rodriguez Chavez et al.

(10) Patent No.: US 12,680,747 B2
(45) Date of Patent: Jul. 14, 2026

(54) AIRFLOW METHOD AND AIRFLOW SYSTEM FOR TEMPERATURE CONTROL IN A REFRIGERATION APPLIANCE

(71) Applicant: BSH Hausgeräte GmbH, Munich (DE)

(72) Inventors: Jose Alberto Rodriguez Chavez, Oak Ridge, TN (US); Necati Bora Gürel, Augsburg (DE); Veysel Tekce, Tekirdag (AR); Gürcan Durmaz, Tekirdag (AR); Senol Gök, Tekirdag (AR)

(73) Assignee: BSH Hausgeräte GmbH, Munich (DE)

( * ) Notice: Subject to any disclaimer, the term of this patent is extended or adjusted under 35 U.S.C. 154(b) by 390 days.

(21) Appl. No.: 18/529,062

(22) Filed: Dec. 5, 2023

(65) Prior Publication Data

US 2024/0183600 A1 Jun. 6, 2024

(51) Int. Cl.
*F25D 17/04* (2006.01)
*F25D 17/06* (2006.01)

(52) U.S. Cl.
CPC ..... *F25D 17/065* (2013.01); *F25D 17/045* (2013.01); *F25D 2700/12* (2013.01)

(58) Field of Classification Search
CPC .. F25D 17/065; F25D 17/045; F25D 2700/12; F25D 2323/0021; F25D 23/12; F25D 2317/04; F25D 2700/121; F25D 2700/10; F25D 11/02; F25D 17/04; F25D 17/06; F25D 17/08; F25D 17/067; F25D 25/025; F25D 2317/0682;

(Continued)

(56) References Cited

U.S. PATENT DOCUMENTS 10,976,094 B2 * 4/2021 Lee ..... F25B 41/37
2014/0013794 A1 * 1/2014 Junge ..... F25D 17/065 62/426

(Continued)

FOREIGN PATENT DOCUMENTS

EP 0592004 A1 * 4/1994 ..... F25D 17/065
KR 20010018430 A * 3/2001

(Continued)

OTHER PUBLICATIONS

Hamada, Kazuyuki, WO2017209032 Translation.pdf, "Refrigerator", Dec. 2017, pp. 1-79.*

(Continued)

*Primary Examiner* — Michael G Hoang
*Assistant Examiner* — Ryan L Faulkner
(74) *Attorney, Agent, or Firm* — Laurence A. Greenberg; Werner H. Stemer; Ralph E. Locher

(57) ABSTRACT

An airflow system is provided in a refrigeration appliance that includes first and second fans. The first fan distributes first air from an evaporator of the refrigeration appliance and the second fan distributes second air from the evaporator. The airflow system has a first damper that receives the first air from the first fan and directs the first air to a first set of compartments. Additionally, the airflow system includes a second damper that receives the second air from the second fan and directs the second air to a second set of compartments. The airflow system has a housing that stores at least one of the first fan and the second fan and at least one of the first damper and the second damper.

15 Claims, 5 Drawing Sheets

(58) Field of Classification Search
CPC ... F25D 2317/0683; F24F 11/77; F24F 11/74; F24F 11/79; F24F 2110/30; F24F 2140/40; F24F 13/10
USPC ..... 454/183
See application file for complete search history.

(56) References Cited

U.S. PATENT DOCUMENTS

| | | | | |
|---|---|---|---|---|
| 2018/0224185 | A1* | 8/2018 | Besore | F25D 17/045 |
| 2019/0301786 | A1* | 10/2019 | Lee | F25D 17/08 |
| 2021/0247112 | A1* | 8/2021 | Jeon | F25B 39/02 |
| 2023/0251012 | A1* | 8/2023 | Fagundes | F25D 17/065 62/408 |

FOREIGN PATENT DOCUMENTS

| | | | | |
|---|---|---|---|---|
| KR | 20110097746 | A * | 8/2011 | F25D 21/08 |
| WO | WO-2017209032 | A1 * | 12/2017 | F25D 17/08 |

OTHER PUBLICATIONS

87Kawa, Ryoji, KR20110097746 Translation.pdf, "Refrigerator", Aug. 2011, pp. 1-87.*
Kim, Jeong, KR20010018430 Translation.pdf, "Refrigerator", Mar. 2001, pp. 1-6.*

* cited by examiner

AIRFLOW METHOD AND AIRFLOW SYSTEM FOR TEMPERATURE CONTROL IN A REFRIGERATION APPLIANCE

CROSS-REFERENCE TO RELATED APPLICATION

This application claims the priority, under 35 U.S.C. § 119, of Turkish Patent Application TR 2022/018591, filed Dec. 5, 2022; the prior application is herewith incorporated by reference in its entirety.

FIELD AND BACKGROUND OF THE INVENTION

The present disclosure relates generally to refrigeration systems and, more particularly (although not necessarily exclusively), to an airflow system for temperature control in a refrigeration appliance.

SUMMARY OF THE INVENTION

Refrigeration systems can include an evaporator and a compressor. The compressor can pump refrigerant through the refrigeration system. For example, a signal from a sensor can indicate that a temperature of the refrigeration system is above a set temperature. In response, the compressor can turn on to pump the refrigerant to facilitate cooling of the refrigeration system. Additionally, the refrigerant pumped by the compressor can pass through the evaporator to cool a surface of the evaporator. Thus, the evaporator can facilitate cooling of air within the refrigeration system. In some examples, the refrigeration system can include one or more compartments and the air cooled by the evaporator can be distributed to the one or more compartments to cool the one or more compartments. A user may set temperatures of the one or more compartments and the evaporator, compressor, and other suitable components can be used to generate the temperatures. Different temperature for different compartments can be desirable to optimize preservation of particular fruits, vegetables, or other perishables.

Other features which are considered as characteristic for the invention are set forth in the appended claims.

Although the invention is illustrated and described herein as embodied in an airflow system for temperature control in a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
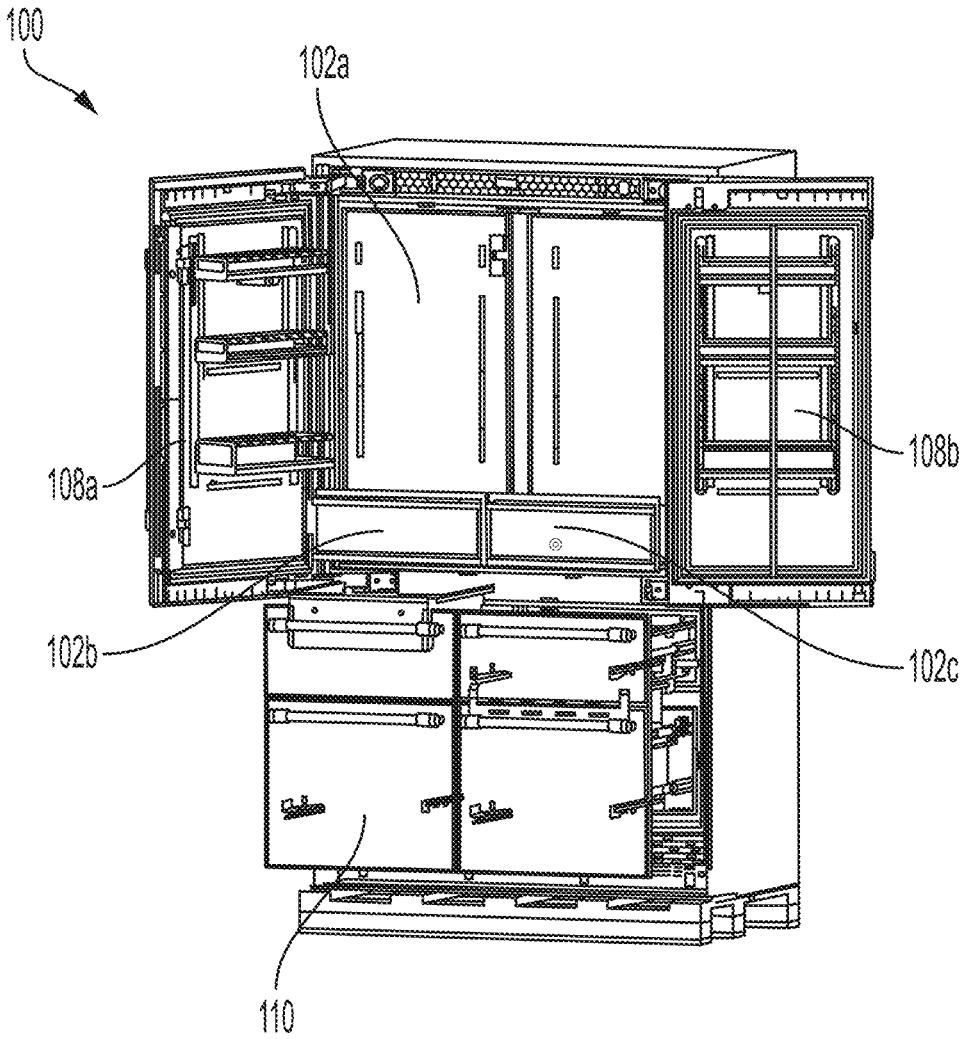
FIG. 1 is a schematic of a front view of a refrigeration appliance according to one example of the invention.

Certain aspects and examples of the present disclosure relate to an airflow system for temperature control in a refrigeration appliance. The airflow system may be included in a refrigeration appliance such as a refrigerator, freezer, or other suitable refrigeration appliance. The refrigeration appliance may include one or more compartments in a body of the refrigeration appliance for storing food or other perishables. The compartments can be drawers, shelfs, or other suitable compartments. Additionally, the refrigeration appliance can include an evaporator, which can be a device with a cool surface for cooling air in the refrigeration appliance. The airflow system can include multiple fans and dampers to distribute and control airflow in the refrigeration appliance. By generating and controlling the airflow in the refrigeration appliance, the airflow system can control the temperature of the refrigeration appliance. Additionally, the airflow system can distribute air evenly to provide a uniform temperature throughout a full volume of the one or more compartments, the body of the refrigeration appliance, or a combination thereof.

Conventional refrigeration systems may not generate sufficient airflow to control the temperature of a large refrigeration appliance. Additionally, in conventional refrigeration systems, a single fan may be used to generate airflow. It may be necessary for the single fan to continually operate at a maximum power to provide the sufficient airflow, which can increase energy consumption and noise level associated with cooling the refrigeration appliance. Embodiments of the present disclosure provide a system with multiple fans that can provide the sufficient airflow to the one or more compartments without to the fans continually operating at the maximum power. Therefore, the system can decrease the energy consumption and the noise level associated with cooling the refrigeration appliance. Additionally, in some examples, different temperatures can be desirable for one or more compartments of the refrigeration appliance, or temperatures of the one or more compartments can change different rates. The airflow system or refrigeration appliance can include sensors for measuring the temperatures of the one or more compartments. Therefore, in some examples, the airflow system may selectively direct airflow, block airflow, or create stronger airflow to the one or more compartments of the refrigeration appliance based on the temperatures.

In a particular example, the airflow system can include a first housing and a second housing, a first fan and a second fan, and a first damper and a second damper. The first fan and the second fan can be devices for distributing airflow. The first damper and the second damper can be devices for balancing or directing airflow from the first fan and the second fan. Additionally, the first fan and the first damper can be positioned within the first housing. The second fan and the second damper can be positioned within the second housing. The refrigeration appliance can further include one or more compartments, such as a refrigeration compartment, a left drawer, and a right drawer. The first damper can include a first flap and a second flap, and the second damper can include a third flap and a fourth flap. The first flap and the third flap can be directed toward the refrigeration compartment, thereby creating two conduits for airflow into the refrigeration compartment. The second flap can be directed toward the left drawer and the fourth flap can be directed toward the right drawer. The first flap, the second flap, the third flap, and the fourth flap can open and close independently of one another to selectively direct airflow from the first fan and the second fan depending on a cooling specification of the refrigeration compartment, the left drawer, the right drawer, or a combination thereof.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Referring now to the figures of the drawings in detail and first, particularly to FIG. 1 thereof, there is shown a schematic of a front view of a refrigeration appliance 100 according to one example of the present disclosure. The refrigeration appliance 100 can be a refrigerator or other suitable refrigeration appliance that can include a first compartment 102*a*, a second compartment 102*b*, a third compartment 102*c*, and one or more freezer compartments 110. The first compartment 102*a* can be a body of the refrigeration appliance and the second compartment 102*b* and the third compartment 102*c* can be drawers, shelves, or other suitable compartments. Additionally, a first door 108*a* and a second door 108*b* are provided for covering the first compartment 102*a*, the second compartment 102*b*, and the third compartment 102*c*.

The airflow system can control temperature in the first compartment 102*a*, the second compartment 102*b*, the third compartment 102*c*, the one or more freezer compartments 110, or a combination thereof. The airflow system can be placed in an interior of the refrigeration appliance 100 and can be placed proximate to an evaporator. In some examples, the airflow system can be positioned horizontally in a bottom portion of the first compartment 102*a*. The airflow system may further be positioned behind the second compartment 102*b* and the third compartment 102*c*. In other examples, the airflow system can be positioned at other locations in the refrigeration appliance 100 or positioned vertically or at a different angle relative to an axis of the refrigeration appliance 100.

Figure 2:
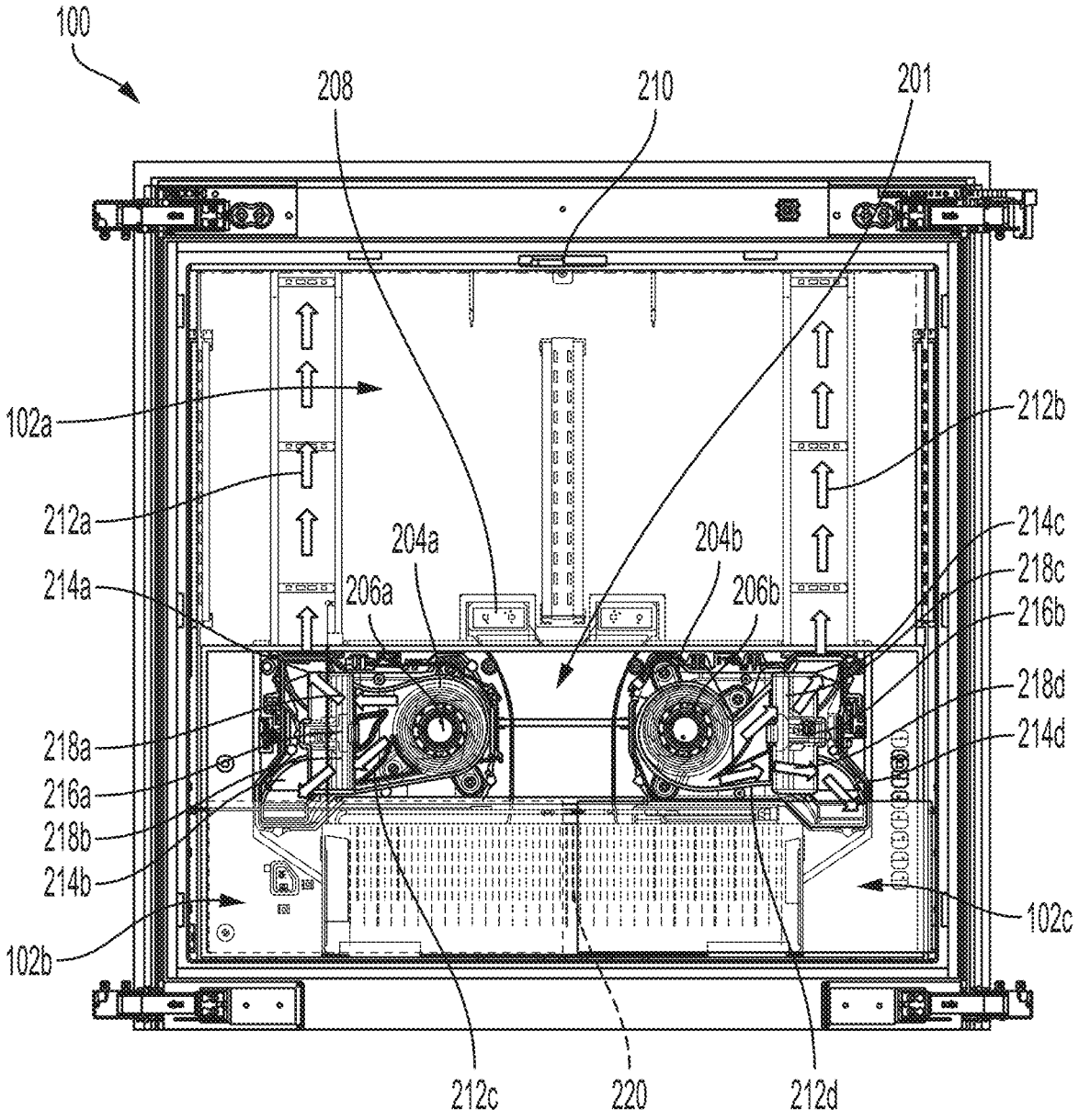
FIG. 2 is a schematic of a front view of the refrigeration appliance including an airflow system according to one example of the invention.

FIG. 2 is a schematic of a front view of a refrigeration appliance 100 including an airflow system 201 according to one example of the present disclosure. The refrigeration appliance 100 may have a width of at least forty-two inches. In some examples, the refrigeration appliance 100 may be a refrigerator, a freezer, or another suitable refrigeration appliance. The refrigeration appliance 100 can include an evaporator 220 for cooling air in the refrigeration appliance 100 to facilitate distribution of cool air by the airflow system 201. The airflow system 201 can distribute the air from the evaporator 220 to compartments 102*a-c* in the refrigeration appliance 100. The compartments 102*a-c* can be refrigeration compartments, freezer compartments, crisper drawers, shelves, or other suitable compartments. In some examples, the refrigeration appliance 100 may include a different number of compartments than is illustrated.

The airflow system 201 can include components such as a first housing 204*a* and a second housing 204*b*, a first fan 206*a* and a second fan 206*b*, and a first damper 216*a* and a second damper 216*b*. The airflow system 201 can, via the components, direct air to provide air to a volume of a first compartment 102*a*, a second compartment 102*b*, a third compartment 102*c*, additional compartments, or a combination thereof. By directing air, the airflow system 201 can control a first temperature of the first compartment 102*a*, a second temperature of the second compartment 102*b*, a third temperature of the third compartment 102*c*, or a combination thereof. Additionally, the airflow system 201 can evenly distribute air to the compartments to provide uniform temperature distribution in the compartments.

In some examples, temperatures of the compartments 102*a-c* can be set by a user or otherwise provided for the refrigeration appliance 100. Each of the compartments 102*a-c* can be different temperatures. The airflow system 201 may produce the different temperatures in the compartments 102*a-c* by selectively directing air or selectively blocking air to the compartments 102*a-c*. For example, the user may set the second compartment 102*b* and the third compartment 102*c* to be a lower temperature than the first compartment 102*a*. The lower temperature of the second compartment 102*b* and the third compartment 102*c* can be used to store raw meat, poultry, or other perishables. Thus, the airflow system 201 may temporarily direct air to the second compartment 102*b* and the third compartment 102*c* and temporarily block air to the first compartment 102*a* to provide the lower temperature. Additionally, in an example, warm air may rise toward a top portion of the first compartment 102*a*. Therefore, additional air may be directed toward the first compartment 102*a* to replace the warm air at the top portion of the first compartment 102*a* with cool air. To provide the additional air, the airflow system 201 may selectively direct air from more than one fan to the first compartment 102*a*.

In an example, the first fan 206*a* and the first damper 216*a* can be positioned within the first housing 204*a*. Additionally, the second fan 206*b* and the second damper 216*b* can be positioned within the second housing 204*b*. The first housing 204*a* and the second housing 204*b* can receive air from the evaporator 220. The first fan 230*a* can distribute first air from the air received by the first housing 204*a* from the evaporator 220. The second fan 230*b* can distribute second air from the air received by the second housing 204*b* from the evaporator 220.

Additionally, the first housing 204*a* can include a first geometry 214*a* that can define a first opening that can extend into the first compartment 102*a*. The first housing 204*a* can further include a second geometry 214*b* that can define a second opening that can extend into the second compartment 102*b*. The second housing 204*b* can include a third geometry 214*c* that can define a third opening that can also extend into the first compartment 102*a*. The second housing 204*b* can also include a fourth geometry 214*d* that can define a fourth opening that can extend into the third compartment 102*c*. Therefore, the airflow system 201 can provide two sources of air for the first compartment 102*a*, which may be the largest of the compartments 102*a-c*. Additionally, the airflow system 201 may provide one source of air per additional compartments, such as drawers, in the refrigeration appliance 100.

The first damper 216*a* can include a first flap 218*a* and a second flap 218*b*. Additionally, the second damper 216*b* can include a third flap 218*c* and a fourth flap 218*d*. The first damper 216*a* can be positioned in the first housing 204*a* such that the first flap 218*a* can cover the first opening of the first geometry 214*a* and the second flap 218*b* can cover the second opening of the second geometry 214*b*. Similarly, the second damper 216*b* can be positioned in the second housing 204*b* such that the third flap 218*c* can cover the third opening of the third geometry 214*c* and the fourth flap 218*d* can cover the fourth opening of the fourth geometry 214*d*. Flaps 218*a-d* can have an open position and a closed position. In the open position, flaps 218*a-d* can allow airflow through corresponding geometries 214*a-d*. In the closed position, flaps 218*a-d* can block airflow through the corresponding geometries 214*a-d*. Additionally, the flaps 218*a-d* can individually switch between the open position and the closed position to selectively allow or block airflow to compartments 102*a-c*.

Therefore, in the example, the airflow system 201 of the refrigeration appliance 100 can create four paths of airflow 212*a-d* for the compartments 102*a-c*. A first airflow path 212*a* can include the first air distributed by the first fan 206*a*. The first air can, when the first flap 218*a* is in the open position, be directed through the first opening of the first geometry 214*a* to the first compartment 102*a*. When the first flap 218*a* is in the closed position the first air can be prevented from reaching the first compartment 102*a*. A second airflow path 212*b* can include the second air distributed by the second fan 206*b*. The second air can be directed through the third opening of the third geometry 214*c* to the first compartment 102*a*. The third flap 218*c* can enable the second airflow path 212*b* in the open position or the third flap 218*c* can block the second airflow path 212*b* in the closed position. A third airflow path 212*c* can include third air distributed by the first fan 206*a*. The third air can be directed through the second opening of the second geometry 214*b* to the second compartment 102*b*. The second flap 218*b* can enable the third airflow path 212*c* in the open position or the second flap 218*b* can block the third airflow path 212*c* in the closed position. A fourth airflow path 212*d* can include fourth air distributed by the second fan 206*b*. The fourth air can be directed through the fourth opening of the fourth geometry 214*d* to the third compartment 102*c*. The fourth flap 218*d* can enable the fourth airflow path 212*d* in the open position or the fourth flap 218*d* can block the fourth airflow path 212*d* in the closed position.

The refrigeration appliance 100 can further include one or more sensors 208 and a mainboard 210. In some examples, the compartments 102*a-c* may each include a sensor. The one or more sensors 208 may be thermistors or other suitable temperature sensors for detecting changes in the temperatures or measuring temperatures of the compartments 102*a-c*. In some examples, the one or more sensors 208 can be other suitable sensor types such as a proximity sensor or a reed sensor. Additionally, the mainboard 210 can be a device for receiving temperature data or other suitable data from the one or more sensors 208 and sending requests to the compressor or the evaporator 220 based on the data. The mainboard 210 can further be a device for sending signals to the fans 206*a-b* and dampers 216*a-b*. The mainboard 210 and the one or more sensors 208 can be communicatively coupled to the first fan 206*a*, the second fan 206*b*, the first damper 216*a*, the second damper 216*b*, or a combination thereof. The mainboard may also send requests to control the first fan 206*a*, the second fan 206*b*, the first damper 216*a*, the second damper 216*b*, or a combination thereof.

In some examples, the one or more sensors 208 can measure the first temperature of the first compartment 102*a*, the second temperature of the second compartment 102*b*, the third temperature of the third compartment 102*c*, or a combination thereof. Additionally, compartments 102*a-c* can have corresponding set temperatures. The mainboard 210 can, for example, receive a request for cooling the first compartment 102*a* from the airflow system 201 based on a difference between the first temperature and the set temperature of the first compartment 102*a*. In response, the compressor can turn on, which can pump refrigerant to the evaporator 220 to facilitate cooling of air for use by the airflow system 201. The mainboard 210 may also receive a request for cooling the second compartment 102*b* or a request for cooling the third compartment 102*c*. In some examples, the request for cooling the second compartment 102*b* and the request for cooling the third compartment 102*c* can only be made after the request for cooling the first compartment 102*a* to create an efficient air-cooling cycle.

Additionally or alternatively, the mainboard 210 can communicate with the airflow system 201 to determine or control a first speed of the first fan 206*a*, a second speed of the second fan 206*b*, a first position of the first flap 218*a*, a second position of the second flap 218*b*, a third position of the third flap 218*c*, a fourth position of the fourth flap 218*d*, or a combination thereof. In some examples, the first speed can be different from the second speed to generate stronger airflow to a certain compartment or set of compartments. Additionally, the flaps 218*a-d* can be put into different positions to enable or block airflow to the certain compartment or set of compartments. For example, in response to a temperature increase in the third compartment 102*c*, the mainboard 210 can cause the second speed of the second fan 206*b* to increase, the third flap 218*c* to move to a closed position, and the fourth flap 218*d* to move to an open position.

In an example, the one or more sensors 208 can determine a current position of the flaps 218*a-d* and a current speed of the fans 206*a-b*. The mainboard 210 can receive the current position of the flaps 218*a-d* and the current speed of the fans 206*a-b* from the one or more sensors 208. Additionally or alternatively, the mainboard 210 can communicate with the dampers 216*a-b* and the fans 206*a-b* to determine the current position of the flaps 218*a-d* and the current speed of the fans 206*a-b*. The mainboard 210 may further receive temperatures of the compartments 102*a-c* from the one or more sensors 208. The mainboard 210 may also receive set temperatures of the compartments 102*a-c* that can be based on settings provided by the user. The mainboard 210 may send a signal to one or both of the dampers 216*a-b* to change a position of one or more of the flaps 218*a-d*. Additionally, the mainboard 210 may send a signal to one or both of the fans 206*a-b* to change a speed of one or both of the fans 206*a-b*. The signal sent by the mainboard 210 to the fans 206*a-b*, the dampers 216*a-b*, or a combination thereof can be based on a difference between the temperatures measured by the sensor and the set temperatures.

Additionally, in response to the compressor turning on, the first fan 206*a* and the second fan 206*b* be can activated. In response to the compressor turning off, the first fan 206*a* and the second fan 206*b* can be deactivated. In some examples, the first fan 206*a* and the second fan 206*b* may be deactivated for a timeframe that the compressor is turned off to prevent wasted energy. Moreover, when the compressor is turned off and the fans are deactivated, the flaps 218*a-d* can be in the closed position to prevent a reversal of airflow (e.g., airflow from the compartments 102*a-c* to the evaporator 220). The reversal of airflow can cause damage to components, such as ducts, in the refrigeration appliance 100.

Figure 3:
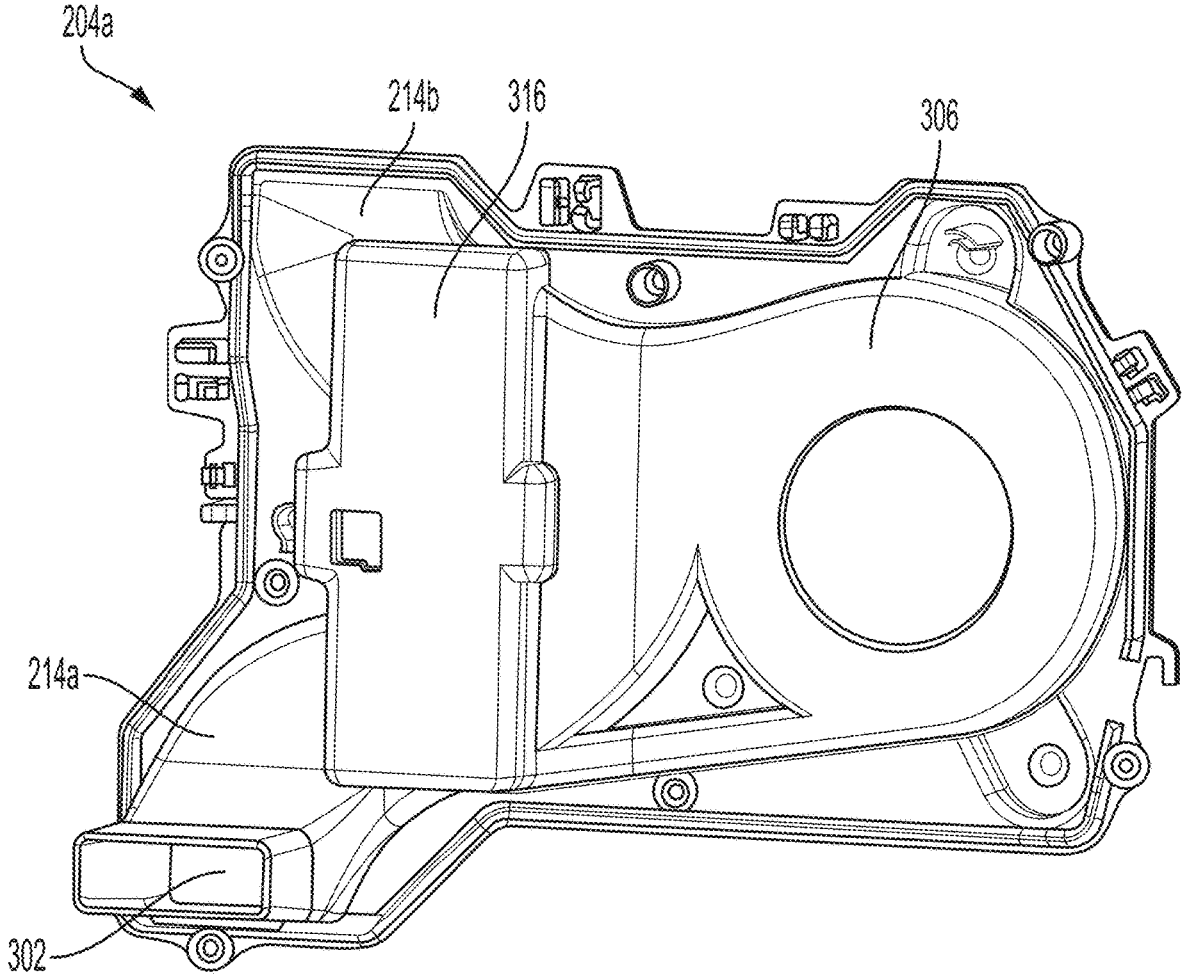
FIG. 3 is a perspective view of a portion of a housing of an airflow system according to one example of the invention.

FIG. 3 is a perspective view of a portion of a housing of an airflow system 201 according to one example of the present disclosure. The portion of the housing can be a portion of a first housing 204*a*. Additionally, the portion of the first housing 204*a* can be half of a housing and can be coupled with a second half to store a damper and a fan. The portion of the first housing 204*a* can include a first section 306 that can be for storing the fan and a second section 316 that can be for storing the damper. The portion of the first housing 204*a* can further include a first geometry 214*a* that can define a first opening 302. Additionally, a second geometry 214*b* can define a second opening. In a refrigeration appliance, the first opening 302 can be placed inside or otherwise connected to a compartment of the refrigeration appliance to provide airflow to the compartment.

The portion of the first housing 204*a* can be various shapes and sizes. The first section 306 and the second section 316 may also be various shapes and sizes. For example, the shape or size of the first section 306 may change for a different fan type or a different fan size. Similarly, the shape or size of the second section 316 can change for a different damper type or a different damper size. In an example, a housing with one geometry may use a single damper with one flap rather than a double damper with two flaps. Therefore, the second section 316 can be altered to fit the single damper.

Additionally, in some examples, the portion of the first housing 204*a* can include a different number of sections. The portion of the first housing 204*a* can also include a different number of geometries. For example, a housing can be provided that has four geometries. Additionally, the housing may include a first section for positioning a first fan in the housing. The housing may further include a second section for positioning a second fan in the housing. A third section can be for positioning a first damper in the housing and a fourth section can be for positioning a second damper in the housing. Therefore, in an example, a single housing can be used in an airflow system to distribute air to a number of compartments in a refrigeration appliance. In other examples, two or more housings can be used in the airflow system. Additionally, in some examples, each housing can include a different number of geometries, sections, or a combination thereof based on a number of compartments to which the airflow system is distributing air. The number of geometries, sections, or a combination thereof may also be based on the size of the compartments since, for example, a larger compartment can involve more than one source of airflow.

Figure 4:
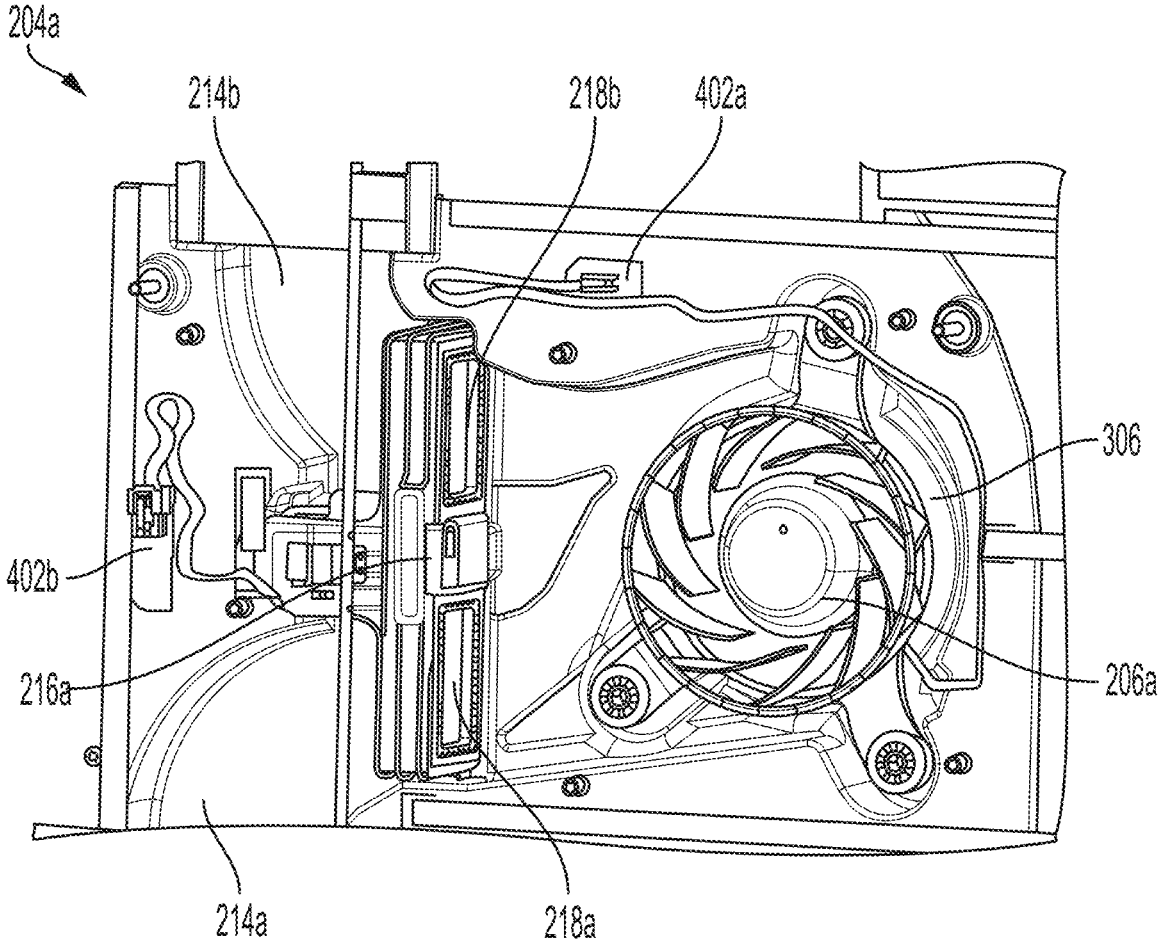
FIG. 4 is a schematic side view of a fan and a damper of an airflow system according to one example of the invention.

FIG. 4 is a schematic of a fan and a damper of an airflow system 201 according to one example of the present disclosure. The damper can be a first damper 216*a* and the fan can be a first fan 206*a*. The first fan 206*a* can be placed in the first section 306. The first damper 216*a* can be placed in the second section 316. The first damper 216*a* can include a first flap 218*a* and a second flap 218*b*. As illustrated, the first flap 218*a* and the second flap 218*b* can be in a closed position, in which the first flap 218*a* and the second flap 218*b* can prevent airflow through the first geometry 214*a* and the second geometry 214*b*. Additionally, the first flap 218*a* or the second flap 218*b* can be in an open position, in which the first flap 218*a* or the second flap 218*b* can allow air to pass through the first geometry 214*a* or the second geometry 214*b*. Additionally, the first housing 204*a* can include first slots 402*a* and second slots 402*b* for connecting the first fan 206*a* and the first damper 216*a* to a power source, sensor, or other suitable device.

Figure 5:
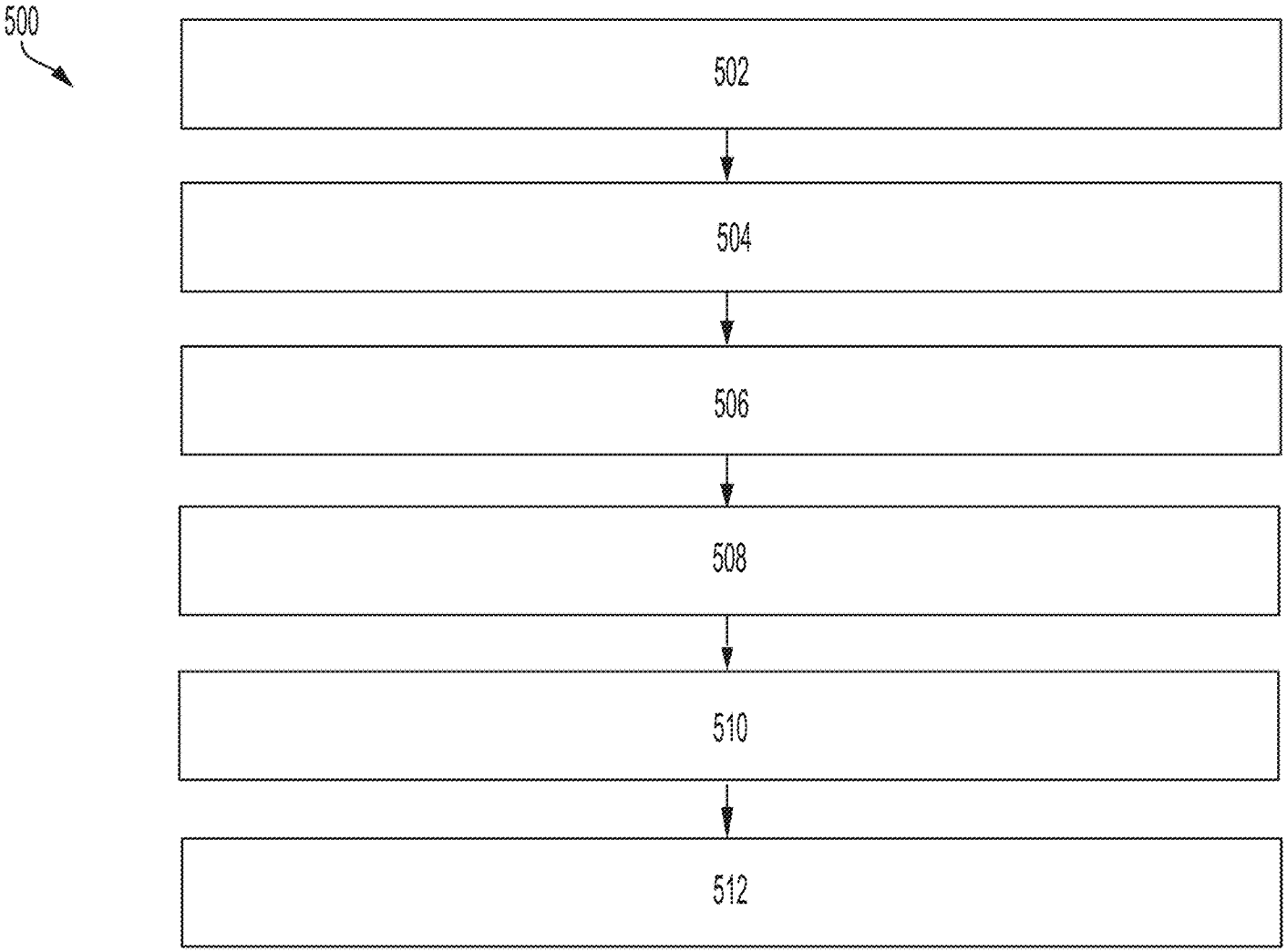
FIG. 5 is a flowchart of a process for controlling temperature in a refrigeration appliance using an airflow system according to one example of the invention.

FIG. 5 is a flowchart of a process for controlling temperature in a refrigeration appliance 100 using an airflow system 201 according to one example of the present disclosure. Aspects of FIG. 5 are discussed with respect to the components in FIG. 2.

At first block 502, the airflow system 201 can distribute, by a first fan 206*a* positioned within at least one housing, first air from an evaporator 220 of a refrigeration appliance 100. The refrigeration appliance 100 can include compartments 102*a-c*. The evaporator 220 can be a device for converting refrigerant to gas to generate cool air in the refrigeration appliance 100. The evaporator 220 can be positioned proximate to the airflow system 201. The evaporator can further be positioned between a first compartment 102*a*, a second compartment 102*b*, and a third compartment 102*c*. The first fan 206*a* can distribute the first air by moving the air that can be cooled by a surface of the evaporator 220.

At second block 504, the airflow system 201 can distribute, by a second fan 206*b* positioned within the at least one housing, second air from the evaporator of the refrigeration appliance 100. The second fan 206*b* can distribute the second air by moving the air that can be cooled by the surface of the evaporator 220. In an example, the first fan 206*a* can be positioned in a first housing 204*a* and the second fan 206*b* can be positioned in a second housing 204*b*. In another example, the first fan 206*a* and the second fan 206*b* can be positioned in one housing.

In some examples, the first fan 206*a* and the second fan 206*b* in the airflow system 201 can distribute airflow in the refrigeration appliance 100 by operating at different speeds. A first speed of the first fan 206*a* can depend on temperatures of a first set of the compartments 102*a-c*. A second speed of the second fan 206*b* can depend on temperatures of a second set of the compartments 102*a-c*. For example, the first fan 206*a* can be associated with the second compartment 102*b* and the second fan 206*b* can be associated with the third compartment 102*c*. A sensor can detect an increase in temperature for the second compartment 102*b*. In response, a mainboard 210 can send a signal to the first fan 206*a* to increase the first speed. Additionally, as both the first fan 206*a* and the second fan 206*b* can provide airflow, the fans 206*a-b* may not be required to work at a maximum speed, which can save energy and increase the lifespan of the fans 206*a-b*.

At third block 506, the airflow system 201 can receive, by a first damper 216*a* positioned within the at least one housing, the first air from the first fan 206*a*. The first damper 216*a* can include a first flap 218*a* and a second flap 218*b*, which can have an open position and a closed position. The first damper 216*a* can be a device for controlling airflow from a freezer, fan, compartment, evaporator, etc. to another compartment or suitable portion of the refrigeration appliance 100. The first damper 216*a* can be positioned in the first housing 204*a*. The first housing 204*a* can include a first geometry 214*a* and a second geometry 214*b*. The first geometry 214 can extend into the first compartment 102*a*. The second geometry 214*b* can extend into the second compartment 102*b*. The first damper 216*a* can be positioned in the first housing 204*a* such that the first flap 218*a* can extend across the first geometry 214*a* and the second flap 218*b* can extend across the second geometry 214*b*.

At fourth block 508, the airflow system 201 can receive, by a second damper 216*b* positioned within the at least one housing, the second air from the second fan 206*b*. The second damper 216*b* can include a third flap 218*c* and a fourth flap 218*d*, which can have an open position and a closed position. The second damper 216*b* can also be a device for controlling airflow from a freezer, fan, compartment, evaporator, etc. to another compartment or suitable portion of the refrigeration appliance 100. The second damper 216*b* can be positioned in the second housing 204*b*. The second housing 204*b* can include a third geometry 214*c* and a fourth geometry 214*d*. The third geometry 214*c* can extend into the first compartment 102*a* and the fourth geometry can extend into the third compartment 102*c*. The second damper 216*b* can be positioned in the second housing 204*b* such that the third flap 218*c* can extend across the third geometry 214*c* and the fourth flap 218*d* can extend across the fourth geometry 214*d*.

In an example, the first damper 216*a* and the second damper 216*b* can be positioned in a single housing. The single housing may also include the first fan 206*a* and the second fan 206*b*. Additionally, the single housing can include the first geometry 214*a*, the second geometry 214*b*, the third geometry 214*c*, and the fourth geometry 214*d*. In other examples, a different number of housings can be used in the airflow system 201. Additionally, the housings may include a different number of fans, dampers, geometries, or a combination thereof.

Additionally, the dampers 216*a-b* can be electrically or mechanically controlled. The fans 206*a-b* can also be electrically or mechanically controlled. Controlling the dampers 216*a-b* can include moving the flaps 218*a-d* to a closed position or to an open position. In some examples, the mainboard 210 can send a signal to the dampers 216*a-b* to change a position of the flaps 218*a-d*.

At fifth block 510, the airflow system 201 can direct, by the first damper 216*a*, the first air from the first fan 206*a* to the first set of the compartments 102*a-c*. For example, the first compartment 102*a* and the second compartment 102*b* can be the first set of the compartments 102*a-c*. The airflow system 201 can direct air, by the first damper 216*a*, to decrease a temperature of the first set of the compartments 102*a-c*. The first damper 216*a* can direct air by opening or closing the flaps 218*a-b*.

In an example, a first sensor in the second compartment 102*b* may detect a change in temperature of the second compartment 102*b*. Additionally, a second sensor in the first compartment 102*a* may not detect a change in temperature of the first compartment 102*a*. The mainboard 210 can receive the change in temperature of the second compartment 102*b* from the first sensor. The mainboard 210 can send a signal to the first damper 216*a* to change a position of the second flap 218*b* to the open position to direct air to the second compartment 102*b*. Additionally, the first flap 218*a* may be in the closed position or the mainboard 210 may cause the first flap 218*a* to be in the closed position.

At sixth block 512, the airflow system 201 can direct, by the second damper 216*b*, the second air from the second fan 206*b* to the second set of the compartments 102*a-c*. For example, the first compartment 102*a* and the third compartment 102*c* can be the second set of the compartments 102*a-c*. The airflow system 201 can direct air, by the second damper 216*b*, to decrease a temperature of the second set of the compartments 102*a-c*. The second damper 216*b* can direct air by opening or closing the third and fourth flaps 218*c-d*.

In an example, a third sensor in the third compartment 102*c* may detect a change in temperature of the third compartment 102*c*. The mainboard 210 can receive the change in temperature of the third compartment 102*c* from the third sensor. The mainboard 210 can send a signal to the second damper 216*b* to change a position of the third flap 218*c* to the open position to direct air to the third compartment 102*c*. Additionally, the fourth flap 218*d* may be in the closed position or the mainboard 210 may cause the fourth flap 218*d* to be in the closed position.

Additionally or alternatively, the process 500 can include the airflow system 201 distributing, by the first fan 206*a*, third air and distributing, by the second fan 206*b*, fourth air. With the first flap 218*a* and the second flap 218*b* in the open position, the airflow system 201 can distribute, by the first fan 206*a*, the first air to the first compartment 102*a* through the first geometry 214*a*. Additionally, the airflow system 201 can distribute, by the first fan 206*a*, the third air to the second compartment 102*b* through the second geometry 214*b*. The third flap 218*c* and the fourth flap 218*d* can also be in the open position, so the airflow system 201 can therefore further distribute, by the second fan 206*b*, the second air to the first compartment 102*a* through the third geometry 214*c*. The airflow system 201 can also distribute, by the second fan 206*b*, the fourth air to the third compartment 102*c* through the fourth geometry 214*d*.

Additionally or alternatively, the airflow system 201 can include the mainboard 210 that can communicate with the first fan 206*a*, the second fan 206*b*, the first damper 216*a*, and the second damper 216*b*. The mainboard 210 can provide an indication of a first speed to the first fan 206*a*, a second speed to the second fan 206*b*, a first position for the first flap 218*a* to the first damper 216*a*, a second position for the second flap 218*b* to the first damper 216*a*, a third position for the third flap 218*c* to the second damper 216*b*, and a fourth position for the fourth flap 218*d* to the second damper 216*b*. Additionally, the airflow system 201 can include one or more sensors 208 that can communicate with the first fan 206*a*, the second fan 206*b*, the first damper 216*a*, and the second damper 216*b*. The first speed, the second speed, the first position, the second position, the third position, and the fourth position can based on a difference between a set temperature of the plurality of compartments and a measured temperature of the plurality of compartments measured by the sensor. The set temperature can be set by a user.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

The following is a summary list of reference numerals and the corresponding structure used in the above description of the invention.

REFERENCE LIST

100. Refrigeration Appliance
102*a*. First compartment
102*b*. Second compartment
102*c*. Third compartment
108*a*. First door
108*b*. Second door
110. Freezer compartments
201. Airflow system
204*a*. First housing
204*b*. Second housing
206*a*. First fan
206*b*. Second fan
208. Sensor
210. Mainboard
212*a*. First airflow path
212*b*. Second airflow path
212*c*. Third airflow path
212*d*. Fourth airflow path
214*a*. First geometry
214*b*. Second geometry

214*c*. Third geometry
214*d*. Fourth geometry
216*a*. First damper
216*b*. Second damper
218*a*. First flap
218*b*. Second flap
218*c*. Third flap
218*d*. Fourth flap
220. Evaporator
302. First opening
306. First section
316. Second section
402*a*. First slot
402*b*. Second slot
502. First block
504. Second block
506. Third block
508. Fourth block
510. Fifth block
512. Sixth block

The invention claimed is:

1. An airflow system, comprising:

a first fan configured to distribute first air from an evaporator of a refrigeration appliance, the refrigeration appliance including a plurality of compartments;

a second fan configured to distribute second air from the evaporator of the refrigeration appliance;

a first damper having a first flap and a second flap, said first damper configured to receive the first air from said first fan and direct the first air to a first set of the plurality of compartments;

a second damper having a third flap and a fourth flap, said first flap, said second flap, said third flap, and said fourth flap having an open position and a closed position, and said second damper configured to receive the second air from said second fan and direct the second air to a second set of the plurality of compartments; and a housing storing at least one of said first fan and said second fan and at least one of said first damper and said second damper.

2. The airflow system of claim 1, wherein the first set of the plurality of compartments includes a first compartment and a second compartment and the second set of the plurality of compartments includes the first compartment and a third compartment;

wherein said housing is a first housing storing said first fan and said first damper, said first housing further having a first geometry defining a first opening extending into the first compartment and a second geometry defining a second opening extending into the second compartment; and further comprising a second housing storing said second fan and said second damper, said second housing having a third geometry defining a third opening extending into the first compartment and a fourth geometry defining a fourth opening extending into the third compartment.

3. The airflow system according to claim 2, wherein:

said first damper is positioned in said first housing with said first flap obstructing said first geometry and said second flap obstructing said second geometry in the closed position; and said second damper is positioned in said second housing with said third flap obstructing said third geometry and said fourth flap obstructing said fourth geometry in the closed position.

4. The airflow system according to claim 2, wherein:

said first fan is configured to distribute third air and said second fan is configured to distribute fourth air, wherein with said first flap and said second flap in the open position, said first fan is configured to:

distribute the first air to the first compartment through said first geometry; and distribute the third air to the second compartment through said second geometry;

with said third flap and said fourth flap in the open position, said second fan is configured to:

distribute the second air to the first compartment through said third geometry; and distribute the fourth air to the third compartment through said fourth geometry.

5. The airflow system according to claim 1, wherein a first speed of said first fan is different than a second speed of said second fan.

6. The airflow system according to claim 1, wherein:

said first fan and said second fan are configured to be activated or deactivated substantially contemporaneously; and said first flap, said second flap, said third flap, and said fourth flap are configured to be in the closed position for a timeframe that said first fan and said second fan are deactivated.

7. The airflow system according to claim 1, further comprising:

a mainboard configured to communicate with said first fan, said second fan, said first damper, and said second damper, wherein said mainboard is configured to provide an indication of a first speed to said first fan, a second speed to said second fan, a first position for said first flap to said first damper, a second position for said second flap to said first damper, a third position for said third flap to said second damper, and a fourth position for said fourth flap to said second damper; and a sensor configured to communicate with said first fan, said second fan, said first damper, and said second damper, wherein the first speed, the second speed, the first position, the second position, the third position, and the fourth position are based on a difference between a set temperature of the plurality of compartments and a measured temperature of the plurality of compartments measured by said sensor.

8. The airflow system according to claim 1, wherein a width of the refrigeration appliance is at least 42 inches.

9. A method, which comprises the steps of:

distributing, by a first fan positioned within at least one housing, first air from an evaporator of a refrigeration appliance, the refrigeration appliance including a plurality of compartments;

distributing, by a second fan positioned within the at least one housing, second air from the evaporator of the refrigeration appliance;

receiving, by a first damper positioned within the at least one housing, the first air from the first fan, the first damper containing a first flap and a second flap;

receiving, by a second damper positioned within the at least one housing, the second air from the second fan, the second damper containing a third flap and a fourth flap, the first flap, the second flap, the third flap, and the fourth flap each having an open position and a closed position;

directing, by the first damper, the first air from the first fan to a first set of the plurality of compartments; and directing, by the second damper, the second air from the second fan to a second set of the plurality of compartments.

10. The method according to claim 9, wherein the first set of the plurality of compartments includes a first compartment and a second compartment and the second set of the plurality of compartments includes the first compartment and a third compartment, wherein the at least one housing contains a first housing and a second housing, wherein the first fan and the first damper are positioned within the first housing, the first housing having a first geometry defining a first opening extending into the first compartment and a second geometry defining a second opening extending into the second compartment, and wherein the second fan and the second damper are positioned within the second housing, the second housing containing a third geometry defining a third opening extending into the first compartment and a fourth geometry defining a fourth opening extending into the third compartment.

11. The method according to claim 10, wherein the first damper is positioned in the first housing with the first flap obstructing the first geometry and the second flap obstructing the second geometry in the closed position, and wherein the second damper is positioned in the second housing with the third flap obstructing the third geometry and the fourth flap obstructing the fourth geometry in the closed position.

12. The method according to claim 10, which further comprises:

distributing, by the first fan, third air; and distributing, by the second fan, fourth air;

performing a distribution of the first air, while the first flap and the second flap are in the open position, with the further substeps of:

distributing, by the first fan, the first air to the first compartment through the first geometry;

distributing, by the first fan, the third air to the second compartment through the second geometry; and performing a distribution of the second air, while the third flap and the fourth flap are in the open position, with the further substeps of:

distributing, by the second fan, the second air to the first compartment through the third geometry; and distributing, by the second fan, the fourth air to the third compartment through the fourth geometry.

13. The method according to claim 12, wherein generating the first air and generating the second air further comprises receiving a first speed for the first fan and receiving a second speed for the second fan, wherein the first speed is different than the second speed.

14. The method according to claim 9, which further comprises:

deactivating the first fan and the second fan substantially contemporaneously, and, for a timeframe that the first fan and the second fan are deactivated, the first flap, the second flap, the third flap, and the fourth flap are in the closed position.

15. The method according to claim 9, which further comprises:

measuring, by a sensor communicatively coupled to the plurality of compartments, at least one measured temperature for the plurality of compartments;

receiving, via a mainboard communicatively coupled to the sensor, the at least one measured temperature and at least one set temperature for the plurality of compartments;

receiving, via the mainboard, a first speed of the first fan, a second speed of the second fan, a first position of the first flap, a second position of the second flap, a third position of the third flap, and a fourth position of the fourth flap; and adjusting, via the mainboard, the first speed of the first fan, the second speed of the second fan, the first position of the first flap, the second position of the second flap, the third position of the third flap, or the fourth position of the fourth flap based on at least one difference between the at least one measured temperature and the at least one set temperature.

* * * * *